US005372904A

United States Patent [19]

Yu et al.

[11] Patent Number: 5,372,904

[45] Date of Patent: Dec. 13, 1994

[54] PHOTORECEPTOR WITH IMPROVED CHARGE BLOCKING LAYER

[75] Inventors: Robert C. U. Yu, Webster; Geoffrey M. T. Foley, Fairport; Satchidanand Mishra, Webster; Richard L. Post, Penfield; Yonn K. Rasmussen, Fairport; John F. Yanus, Webster; Neil S. Patterson, Penfield, all of N.Y.

[73] Assignee: Xerox Corporation, Stamford, Conn.

[21] Appl. No.: 176,733

[22] Filed: Jan. 3, 1994

[51] Int. Cl.[5] ..... G03G 5/10

[52] U.S. Cl. ..... 430/64; 430/65

[58] Field of Search ..... 430/60, 64, 65, 66, 430/67, 59, 58

[56] References Cited

U.S. PATENT DOCUMENTS

| | | | |
|---|---|---|---|
| 4,464,450 | 8/1984 | Teuscher | 430/59 |
| 4,563,408 | 1/1986 | Lin et al. | 430/59 |
| 4,584,253 | 4/1986 | Lin et al. | 430/59 |
| 4,780,385 | 10/1988 | Wielock et al. | 430/58 |

*Primary Examiner*—John Goodrow

[57] ABSTRACT

An electrophotographic imaging member comprising a substrate having an electrically conductive metal oxide surface, a hole blocking layer and at least one electrophotographic imaging layer, the hole blocking layer comprising a reaction product of (a) a material selected from the group consisting of a hydrolyzed organozirconium compound, a hydrolyzed organotitanium compound and mixtures thereof, (b) a hydroxyalkylcellulose, (c) a hydrolyzed organoaminosilane, and (d) the metal oxide surface.

12 Claims, No Drawings

PHOTORECEPTOR WITH IMPROVED CHARGE BLOCKING LAYER

BACKGROUND OF THE INVENTION

This invention relates in general to electrophotography and more specifically, to an electrophotographic imaging member with an improved charge blocking layer and process for using the imaging member.

In the art of electrophotography an electrophotographic plate comprising a photoconductive insulating layer on a conductive layer is imaged by first uniformly electrostatically charging the surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

As more advanced, complex, highly sophisticated, electrophotographic copiers, duplicators and printers were developed, greater demands were placed on the photoreceptor to meet stringent requirements for the production of high quality images. For example, the numerous layers found in many modern photoconductive imaging members must be uniform, free of defects, adhere well to to adjacent layers, and exhibit predictable electrical characteristics within narrow operating limits to provide excellent toner images over many thousands of cycles. One type of multilayered photoreceptor that has been employed as a drum or belt in electrophotographic imaging systems comprises a substrate, a conductive layer, a hole blocking layer, an adhesive layer, a charge generating layer, and a charge transport layer. This photoreceptor may also comprise additional layers such as an overcoating layer. Although excellent toner images may be obtained with multilayered photoreceptors, it has been found that the numerous layers limit the versatility of the multilayered belt photoreceptor. For example, these drums often comprise a metal substrate having a roughed surface to avoid plywooding effects that can occur with laser exposure systems. It has been found that when the drums are dip coated, the hole blocking layer does not consistently form a thick uniform coating on the roughened surface and often leaves uncovered bares spots at the peaks of the roughened substrate surface. These bares spots directly impact copy print quality because they print out as white spot defects on negatively charged photoreceptors. Also, the hole blocking layer coating tends to spontaneously develop extensive layer cracking after drying at elevated temperature to facilitate curing. Thus, there is a great need for mass production dip coating of high quality long service life photoreceptor drums. Cracks developed in charge blocking layers during cycling were manifested as print-out defects which adversely affected copy quality. Moreover, alteration of materials in the various belt layers such as the hole blocking layer, can adversely affect overall electrical, mechanical and other electrophotographic imaging properties of the photoreceptor such as residual voltage, background, dark decay, adhesion and the like, particularly when cycled thousands of times in environments where conditions such as humidity and temperature can change daily.

INFORMATION DISCLOSURE STATEMENT

U.S. Pat. No. 4,584,253 to Lin et al, issued Apr. 22, 1986—An electrophotographic imaging member is disclosed comprising a charge generation layer, a contiguous charge transport layer comprising an aromatic amine or hydrazone charge transport molecule in a continuous polymeric binder phase, and a cellulosic hole trapping material located on the same side of the charge transport layer as the charge generation layer, the cellulosic hole trapping material being free of electron withdrawing groups. The hole blocking layer may comprise, for example, a film of siloxane and hydroxypropyl cellulose. In some cases an intermediate adhesive layer is employed between the hole blocking layer and adjacent charge generating layer to promote adhesion. This adhesive layer has a thickness between about 0.1 micrometer and about 5 micrometers.

U.S. Pat. No. 4,464,450 to Teuscher, issued Aug. 7, 1984—Various overcoated electrophotographic imaging members are disclosed including a multilayered imaging member having a substrate, a metal layer, a metal oxide layer, a siloxane hole blocking layer, an optional intermediate layer, a charge generating binder layer, and a charge transport layer.

U.S. Pat. No. 4,780,385 to Wieloch et al, issued on Oct. 25, 1988—An electrophotographic imaging member is disclosed comprising a metal ground plane comprising zirconium, a hole blocking layer, a charge generation layer, and a hole transport layer.

Thus, there is a continuing need for multilayered photoreceptors having improved blocking layers capable of forming thick uniform coatings, having greater resistance to cracking, greater adhesion to adjacent layers, and exhibiting excellent electrical properties.

SUMMARY OF THE INVENTION

It is, therefore, an object of the present invention to provide an improved electrophotographic imaging member which overcomes the above noted disadvantages.

It is yet another object of the present invention to provide an improved electrophotographic imaging member having a hole blocking layer which exhibits greater adhesion to adjacent layers.

It is a further object of the present invention to provide an electrophotographic imaging member which forms thicker and more uniform hole blocking layers during dip coating.

It is still another object of the present invention to provide an electrophotographic imaging member which is free of cracks in the hole blocking layer.

It is another object of the present invention to provide an electrophotographic imaging member which exhibits excellent electrical properties.

The foregoing objects and others are accomplished in accordance with this invention by providing an electrophotographic imaging member comprising a substrate having an electrically conductive metal oxide surface, a hole blocking layer and at least one electrophotographic imaging layer, the hole blocking layer comprising a reaction product of a material selected from the group consisting of a hydrolyzed organozirconium and a hydrolyzed organotitanium compound, hydroxyalkylcellulose and a hydrolyzed organoaminosilane with the metal oxide surface.

A photoconductive imaging member of this invention may be prepared by providing a substrate having an electrically conductive surface, forming a hole blocking layer comprising the reaction product of hydroxyalkylcellulose, an organoaminosilane, and an organozirconium or organotitanium compound onto the electrically conductive layer, and applying at least one electrophotographic imaging layer on the hole blocking layer.

The substrate may comprise any suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polystyrenes, polyimides, polyamides, polyurethanes, and the like. Typical conductive materials include, for example, aluminum, nickel, stainless steel, chromium, zirconium, titanium and the like. The electrically insulating or conductive substrate may be flexible and may have any number of different configurations such as, for example, a sheet, a scroll, an endless flexible belt, and the like. For rigid substrates, the substrates may be a composite drum comprising a thermosetting or thermoplastic resin and a conductive dispersion of metal particles or, alternatively, a thermosetting or thermoplastic drum having a metal coating. Preferably, the substrate is in the form of a metal drum having a roughened surface. The surface may be roughened by any suitable technique such as grinding, grit blasting, sanding, and the like. If desired, however, the surface may be smooth.

The thickness of the substrate layer depends on numerous factors, including mechanical strength and economical considerations, and thus, this layer for a flexible belt may, for example, have a thickness of at least about 50 micrometers, or of maximum thickness less than about 50 micrometers, provided there are no adverse effects on the final electrophotographic imaging device.

The conductive layer may vary in thickness over substantially wide ranges depending on the optical transparency and flexibility desired for the electrophotographic imaging member. Accordingly, when a flexible electrophotographic imaging belt is desired, the thickness of the conductive layer may be between about 20 angstrom units to about 750 angstrom units, and more preferably from about 50 Angstrom units to about 200 angstrom units for an optimum combination of electrical conductivity, flexibility and light transmission. The conductive layer may be an electrically conductive metal layer which may be formed, for example, on the substrate by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like. Where the substrate itself is an electrically conductive metal, the outer surface thereof performs the function of an electrically conductive layer and a separate electrical conductive layer may be omitted.

The hole blocking layer of this invention is applied to the electrically conductive surface of the electrically conductive layer or directly over an electrically conductive substrate. The applied hole blocking layer after drying comprises the reaction product of hydroxyalkylcellulose, organoaminosilane, organozirconium or organotitanium compound and the oxidized metal surface of a substrate. The hole blocking layer forms an electronic barrier to prevent injection of holes into the adjacent photoconductive layer from the underlying conductive layer. If desired, an adhesive layer may be interposed between the blocking layer and the photoconductive layer to enhance adhesion.

The hydroxyalkylcellulose component of the hole blocking layer coating composition of this invention is a non-ionic cellulose ether available commercially. For example, hydroxyalkylcellulose is available as hydroxypropylcellulose or KLUCEL from Hercules Incorporated. KLUCEL is prepared by reacting alkali cellulose with propylene oxide at elevated temperature and pressure. The propylene oxide can be substituted on the cellulose through an ether linkage at the three reactive hydroxyls present on each anhydroglucose monomer unit of the cellulose chain. It is believed that etherification takes place in such a way that hydroxypropyl substituent groups contain almost entirely secondary hydroxyls. The secondary hydroxyl present in the side chain is available for further reaction with the oxide, and chaining out may take place. This results in formation of side chains containing more than one mole of combined propylene oxide. It is probable that most of the primary hydroxyls on the cellulose have been substituted and that the reactive groups remaining are secondary hydroxyls. Some typical molecular weight values are H-type 1,000,000; G-type 300,000; L-type 100,000; and E-type 60,000. An idealized structure of of a hydroxyalkylcellulose molecule is shown below:

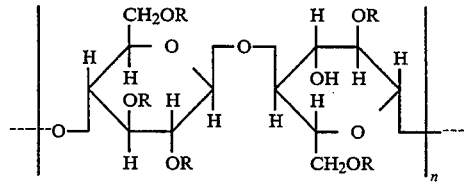

wherein R is independently selected from the group consisting of hydrogen and a substituted or unsubstituted group selected from the group consisting of an alkyl group containing 1 to 20 carbon atoms, a hydroxyalkyl group containing 1 to 20 carbon atoms, an hydroxyether group containing 1 to 20 carbon atoms and an aminoalkyl group containing 1 to 20 carbon atoms, and n is the number of cellulose repeating units from 1 to 3,000. A preferred cellulosic material for the present invention is one selected from the group consisting of a hydroxyalkylcellulose compound and derivatives thereof having a degree of substitution of up to 3 molar substitutions of the hydroxyl group of the cellulose per monosaccharide unit and having a weight average molecular weight between about 700 and about 2,000,000. The abundant hydroxy functional groups of the hydroxypropylcellulose are incorporated into a cross linked network with the zirconium and silane components to form a layer having high thermoplasticity which eliminates cracking of the hole blocking layer which occurs when dip coated hole blocking layers containing only zirconium and silane components are dried by heating. Preferably, the hole blocking layer forming solution comprises between about 0.5 percent by weight and about 9 percent by weight of the hydroxypropylcellulose component based on the total solutes content of the hole blocking layer forming solution. However, a hydroxypropylcellulose content in the hole blocking layer solution between about 1.5 percent by weight to about 3 percent by weight produces optimum results.

The organoaminosilane component of the hole blocking layer coating composition of this invention comprises a hydrolyzable organosilane which reacts with the other components of the hole blocking layer. The hydrolyzable organoaminosilane may be represented by the following formula:

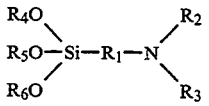

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and $R_4$, $R_5$, and $R_6$ are independently selected from a lower alkyl group containing 1 to 4 carbon atoms. The organoaminosilane is hydrolyzed in an aqueous solution with or without the other components of the charge blocking layer of this invention at a pH between about 4 and about 10. Typical hydrolyzable silanes include 3-aminopropyl triethoxy silane, (N,N-dimethyl 3-amino) propyl triethoxysilane, N,N-dimethylaminophenyl silane, N-phenyl aminopropyl trimethoxy silane, triethoxy silylpropylethylene diamine, trimethoxy silylpropylethylene diamine, trimethoxy silylpropyldiethylene triamine, N-aminoethyl-3-aminopropyltrimethoxysilane, N-2-aminoethyl-3-aminopropyltrimethoxysilane, N-2-aminoethyl-3-aminopropyltris(ethylethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The preferred silane materials are 3-aminopropyltriethoxysilane, N-aminoethyl-3-aminopropyltrimethoxysilane, (N,N'-dimethyl 3-amino)-propyltriethoxysilane, and the like or mixtures thereof because the hydrolyzed solutions of these materials exhibit a greater degree of basicity and stability and because these materials are readily available commercially.

The hydrolyzed organoaminosilane solution may be prepared by adding sufficient water to hydrolyze the hydrolyzable groups attached to the silicon atom to form a solution. During hydrolysis of the organoaminosilanes, the hydrolyzable groups such as alkoxy groups are replaced with hydroxyl groups. Insufficient water will normally cause the hydrolyzed silane to form an undesirable gel. Generally, dilute solutions are preferred for achieving thin coatings. Satisfactory reaction product films may be achieved with solutions containing from about 0.01 percent by weight to about 5 percent by weight of the silane based on the total weight of the solution. A solution containing from about 0.05 percent by weight to about 3 percent by weight silane based on the total weight of solution are preferred for stable solutions which form uniform reaction product layers. It is critical that the pH of the solution of hydrolyzed silane be carefully controlled to obtain optimum effects as on curing as well as electrical stability. A solution pH between about 4 and about 10 is preferred. Optimum reaction product layers are achieved with hydrolyzed silane solutions having a pH between about 7 and about 8, because inhibition of cycling-up and cycling-down characteristics of the resulting treated photoreceptor are maximized. Cycling-down may occasionally be tolerable with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

Any suitable hydrolyzable organozirconium or hydrolyzable organotitanium compound which reacts with the other components of the charge blocking layer of this invention may be utilized. The hydrolyzable organozirconium compound and hydrolyzable organotitanium compound may be represented by the following formula:

wherein

M is selected from the group consisting of zirconium and titanium and

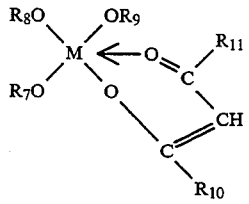

$R_{10}$ and $R_{11}$ are independently selected from lower alkyl groups containing one to 6 carbon atoms.

The hydrolyzable organozirconium compound is hydrolyzed in an aqueous solution with or without the other components of the charge blocking layer of this invention at a pH between about 4 and about 10. Typical hydrolyzable organozirconium compounds include monoacetyl acetonate zirconium tributoxide (e.g. ORGATICS ZC-540, available from Matsumoto Kosho Co.), ethyl acetoacetate zirconium trialkoxide, lactic acid zirconium trialkoxide, and the like. Typical hydrolyzable organotitanium compounds include monoacetyl acetonate titanium tributoxide, ethyl acetoacetate titanium trialkoxide, lactic acid titanium trialkoxide, and the like.

The optimized hole blocking layer coating solution comprises between about 1.5 percent and about 3.5 percent by weight hydroxyalkylcellulose, between about 9.8 percent and about 9.6 percent by weight organosilane, between about 88.7 percent and about 86.9 percent by weight organozirconium or organotitanium compound, based on the total weight of solutes in the coating solution. The coating solution also contains between about 0.650 percent and about 0.647 percent by weight water, between about 56.4 percent and about 56.3 percent by weight isopropyl alcohol, between about 28.3 percent and about 28.2 percent by weight n-butanol, based on the total weight of the hole blocking layer coating solution. Since these solution formulations contain adequate amounts of organic polar solvents and a small quantity of water to promote the hydrolysis reaction, they also promote wetting of the metal oxide layer of metallic conductive anode layers. Improved wetting ensures achievement of greater uniformity of the coating layer thickness as well as a cross-linking reaction between the hydrolyzed silane, hydroxyalkylcellulose, hydrolyzed organozirconium or organotitanium compound and metal oxide layer. Any suitable polar solvent additive may be employed. Typical polar solvents include methanol, ethanol, isopropanol, n-butanol, tetrahydrofuran, methylcellosolve, ethylcellosolve, ethoxyethanol, ethylacetate, ethylformate and mixtures thereof. Optimum, wetting is achieved with a mixture of isopropyl alcohol and n-butanol as the organic polar solvent additive. Generally, the amount of polar solvent added to the hydrolyzed silane solution is less than about 95 percent based on the total weight of the solution for best results.

The hole blocking layer solution may be deposited on the metal oxide surface by any suitable technique. Typical application techniques include spraying, dip coating, draw bar coating, gravure coating, silk screening, air knife coating, reverse roll coating, and the like. The hole blocking layer coating solutions of this invention are especially desirable for dip coating processes. For obtaining relatively thick hole blocking layers free of cracking, the blocking layer are preferably applied by dip coating substrates such as drums in a coating solution, with the solvent being removed after deposition of the coating by conventional techniques such as by vacuum, heating and the like. Generally, a weight ratio of hole blocking layer solutes and solvents of between about 1:6 and about 1:5 for a hydroxyalkylcellulose weight ratio with respect to the total of other solutes of between about 1:60 and about 2:55 is satisfactory for dip coating.

Drying or curing of the hole blocking layer coating upon the metal oxide layer should be conducted at a temperature greater than about room temperature to provide a reaction product layer having more uniform electrical properties, more complete conversion of the reactants and less unreacted components. Generally, a reaction temperature between about 100° C. and about 150° C. is preferred for maximum conversion, adhesion and avoidance of cracking. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depends upon the reaction temperatures used. Thus, less reaction time is required when higher reaction temperatures are employed. Generally, increasing the reaction time increases the degree of cross-linking of the reactants. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and about 10.

The reaction may be conducted under any suitable pressure including atmospheric pressure or in a vacuum. Less heat energy is required when the reaction is conducted at sub-atmospheric pressures.

One may readily determine whether sufficient condensation reaction in the cross-linking process has occurred in the coating to form a network structure having stable electrical, chemical and mechanical properties for the final electrophotographic imaging member to withstand the operating conditions in a machine environment, by merely washing the dried coating with water, toluene, tetrahydrofuran, methylene chloride or cyclohexanone and examining the washed coating to compare infrared absorption of Si-O-wavelength bands between about 1,000 to about 1,200 $cm^{-1}$. If the Si-O-wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer and the other components of the charge blocking layer. The reaction of hydrolyzed silane with metal hydroxide molecules in the pores of the metal oxide layer is described in U.S. Pat. No. 4,464,450 to L. A. Teuscher, the disclosure of which is incorporated herein in its entirety.

The hole blocking layer should be continuous and have a thickness of greater than about 0.5 micrometer (5,000 Angstroms) because thinner hole blocking layer coatings may provide insufficient coverage on the roughened surface of the conductive substrate and may lead to the formation of bare spots at the peaks of the roughened surface. A hole blocking layer of between about 0.7 micrometer (7,000 Angstroms) and about 2 micrometers (20,000 Angstroms) is preferred because complete ground plane/substrate surface coverage can successfully be achieved, hole neutralization after the exposure step is facilitated, and optimum electrical performance is achieved. A thickness of between about 1 micrometer (10,000 Angstroms) and about 1.5 micrometers (15,000 Angstroms) is particularly preferred for hole blocking layers in order to achieve optimum electrical behavior. After drying, a reaction product of the organoaminosilane, hydroxyalkylcellulose, organozirconium or organotitanium compound, and the metal oxide on the underlying conductive surface is formed. An idealized depiction of the reaction is described in the following schematic representations:

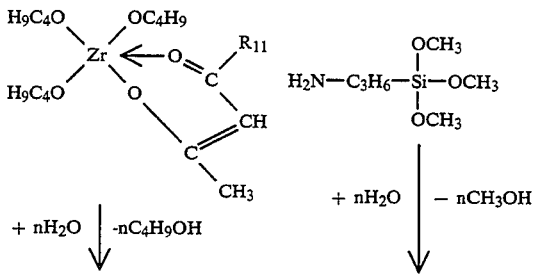

-continued

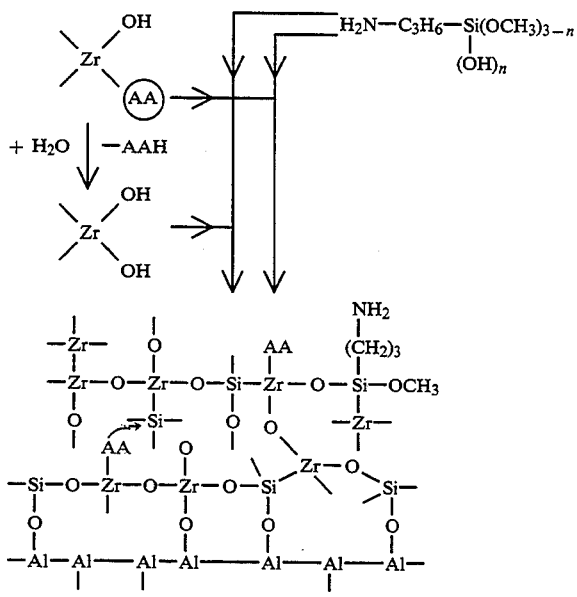

In the schematic representations above, "AA" represents acetylacetonate and Al represents aluminum atoms at the outer surface of the conductive substrate.

An optional adhesive layer may be applied to the hole blocking layer. Any suitable adhesive layer may be utilized. One well known adhesive layer comprises a polyester resin known as du Pont 49,000 (available from duPont de Nemours & Co.), a linear saturated copolyester reaction product of four diacids and ethylene glycol. The du Pont 49,000 linear saturated copolyester consists of alternating monomer units of ethylene glycol and four randomly sequenced diacids in the above indicated ratio and has a weight average molecular weight of about 70,000 and a $T_g$ of about 32° C. If desired, the adhesive layers may comprise a copolyester resin such as, for example, Vitel PE-100, Vitel PE-200, Vitel PE-200D, and Vitel PE-222, all available from Goodyear Tire and Rubber Co. The adhesive layer comprising this polyester resin is applied to the blocking layer. Any adhesive layer employed should be continuous and preferably, have a dry thickness between about 200 micrometers and about 900 micrometers and more preferably between about 400 micrometers and about 700 micrometers. Any suitable solvent or solvent mixtures may be employed to form a coating solution of the polyester. Typical solvents include terahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer. Typical application techniques include spraying, dip coating, roll coating, wire wound rod coating, and the like. Drying of the deposited coating may be effected by any suitable conventional technique such as oven drying, infra red radiation drying, air drying and the like.

Any suitable photogenerating layer may be applied to the blocking layer or intermediate layer if one is employed, which can then be overcoated with a contiguous hole transport layer. Examples of photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, quinacridones available from E. I. duPont de Nemours & Co. under the tradename Monastral Red, Monastral violet and Monastral Red Y, Vat Orange 1 and Vat Orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layer comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infrared light.

Numerous inactive resin materials may be employed in the photogenerating binder layer including those described, for example, in U.S. Pat. No. 3,121,006, the entire disclosure of which is incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

The active charge transport layer may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 angstroms to 9000 angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material which is an insulator to the extent that an electrostatic charge placed on the transport layer is not conducted in the absence of illumination.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

An especially preferred transport layer employed in one of the two electrically operative layers in the multilayer photoconductor of this invention comprises from about 35 percent to about 45 percent by weight of at least one charge transporting aromatic amine compound, and about 65 percent to about 55 percent by weight of a polymeric film forming resin in which the aromatic amine is soluble.

The charge transport layer forming mixture preferably comprises an aromatic amine compound. The substituents should be free form electron withdrawing groups such as $NO_2$ groups, CN groups, and the like Typical aromatic amine compounds include triphenylmethane, bis(4-diethylamine-2-methylphenyl)-phenylmethane; 4'-4''-bis(diethylamino)-2',2 ''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

Generally, the thickness of the hole transport layer is between about 5 to about 100 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Other layers such as conventional ground strips comprising, for example, conductive particles dispersed in a film forming binder may be applied to one edge of the photoreceptor in contact with the concuctive ground plane layer, hole blocking layer, adhesive layer or charge generating layer.

Optionally, an overcoat layer may also be utilized to improve resistance to abrasion. In some flexible electrophotgraphic imaging members, an anticurl backcoating may be applied to the side opposite the side bearing the electrically active coating layers in order to provide flatness and/or abrasion resistance. These overcoating and anticurl backcoating layers may comprise organic polymers or inorganic polymers that are electrically insulating or slightly semi-conductive. In embodiments using rigid drum imaging devices, an anticurl coating is not employed.

The electrophotographic imaging member of the present invention may be employed in any suitable and conventional electrophotographic imaging process which utilizes negative charging prior to imagewise exposure to activating electromagnetic radiation. When the imaging surface of an electrophotographic member is uniformly charged with a negative charge and imagewise exposed to activating electromagnetic radiation, Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the negatively charged areas or discharged areas on the imaging surface of the electrophotographic member of the present invention. More specifically, for positive development, positively charged toner particles are attracted to the negatively charged electrostatic areas of the imaging surface and for reversal development, negatively charged toner particles are attracted to the discharged areas of the imaging surface.

The electrophotographic imaging members of the present invention contain hole blocking layers which provide absolutely complete roughened ground plane/substrate coverage, exhibit more uniform electrical properties, resist cracking, and adhere better to adjacent layers.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

A 3-mil biaxially oriented polyethylene terephthalate (polyester) substrate film was vacuum coated with an aluminum layer. The exposed surface of the aluminum layer was oxidized by exposure to oxygen in the ambient atmosphere. A hole blocking layer solution was prepared by mixing 43.5 gms isopropyl alcohol, 21.8 gms n-butanol, and 0.5 gm distilled water in a glass bottle for 30 minutes prior to the addition of 10 gms monoacetyl acetonate zirconium tributoxide (ORGATICS ZC-540, available from Matsumoto Kosho Co.) and 1.1 gms 3-aminopropyltrimethoxysilane (NUC SILANE A-1110, available from Nihon Unicor Co.). This coating solution was then stirred for 30 minutes and applied over the aluminized polyester substrate by hand coating, using a half mil gap bar, to yield a 0.7 micrometer (7,000 Angstroms) thick dried charge blocking layer after drying at 135° C. for 5 minutes in an air circulating oven. Examination of the dried blocking layer under 100× magnification with a reflection optical microscope revealed the presence of an extensive network of cracks in the layer. A charge generation layer coating mixture consisting of 97 percent by weight cyclohexanone, 3 percent by weight solids of 75 parts metal free phthalocyanine and 25 parts polyvinyl butyral binder (BMS, available from Sekisui Chemical Co., Ltd.) was applied using a half mil gap bar to give a dried charge generator layer having a thickness of about 1 micrometer after drying at 135° C. for 5 minutes in an air circulating oven. The charge generating layer was then overcoated with a charge transport layer coating solution of 82 percent by weight monochlorobenzene and 18 percent by weight of a dissolved solid mixture of 60 parts 4,4'-cyclohexilidene diphenyl polycarbonate binder having a weight average molecular weight of 40,000 (available from Mitsubishi Chemicals) and 40 parts N,N'-diphenyl-N,N'-bis(3-methylphenyl)-[1,1'-biphenyl]-4,4'-diamine, using a 3-mil gap bar. After drying at 135° C. for 5 minutes, a completed photoreceptor device was formed having a 24 micrometer thick charge transport layer. This device was a control device.

EXAMPLE II

The procedures described in Example I were repeated for photoreceptor fabrication using identical materials except that for hole blocking layer solution preparation, the isopropanol was replaced methanol and a small amount of hydroxypropyl cellulose (KLUCEL HF, available from Hercules Inc.) was added to the coating solution at a solutes weight ratio of hydroxypropyl cellulose to the combination of monoacetyl acetonate zirconium tributoxide and silane of 1:59 (this represents 1.6:7 percent by weight hydroxypropyl cellulose with respect to the total amount of solutes). This coating solution was coated onto an aluminized polyester substrate, using a 1-mil gap bar. Upon drying as described in Example I, the resulting dried hole blocking layer had a thickness of about 1.4 micrometers (14,000 Angstroms). Examination of the dried layer under 100× magnification with a reflection optical microscope showed no hole blocking layer cracking.

EXAMPLE III

The procedures described in Example II were repeated for photoreceptor fabrication using identical materials except that for hole blocking layer solution preparation, hydroxypropyl cellulose was added to the coating solution at a solutes weight ratio of hydroxypropyl cellulose to the combination of monoacetyl acetonate zirconium tributoxide and silane of 2:58 (this represents 3.33 percent by weight hydroxypropyl cellulose with respect to the total amount of solutes). This coating solution was coated onto an aluminized polyester substrate, using a 1.5-mil gap bar. Upon drying as described in Example II, the resulting dried hole blocking layer had a thickness of about 2.8 micrometers (28,000 Angstroms). Examination of the dried layer under 100× magnification with a reflection optical microscope showed no hole blocking layer cracking.

EXAMPLE IV

The procedures described in Example II were repeated for photoreceptor fabrication using identical materials except that for hole blocking layer solution preparation, hydroxypropyl cellulose was added to the coating solution at a solutes weight ratio of hydroxypropyl cellulose to the combination of monoacetyl acetonate zirconium tributoxide and silane of 3:57 (this represents 5.0 percent by weight hydroxypropyl cellulose with respect to the total amount of solutes). This coating solution was coated onto an aluminized polyester substrate, using a 1.5-mil gap bar. Upon drying as described in Example II, the dried blocking layer had a thickness of about 3 micrometers (30,000 Angstroms). Examination of the dried hole blocking layer under 100× magnification with a reflection optical microscope showed no hole blocking layer cracking.

EXAMPLE V

The procedures described in Example II were repeated for photoreceptor fabrication using identical materials except that for hole blocking layer solution preparation, hydroxypropyl cellulose was added to the coating solution at a solutes weight ratio of hydroxypropyl cellulose to the combination of monoacetyl acetonate zirconium tributoxide and silane of 5:55 (this represents 8.33 percent by weight hydroxypropyl cellulose with respect to the total amount of solutes). This coating solution was coated onto an aluminized polyester substrate, using a 1.5-mil gap bar. Upon, drying as described in Example II, the dried hole blocking layer had a thickness of about 3 micrometers (30,000 Angstroms). Examination of the dried hole blocking layer under 100× magnification with a reflection optical microscope showed no hole blocking layer cracking.

EXAMPLE VI

Viscosity tests were conducted on each of the hole blocking layer solutions and adhesion tests on the completed photoreceptors described in the above Examples. More specifically, the viscosities of the charge blocking layer solutions were measured using a Brookfield viscometer. A 180° reverse peel strength test was conducted on all of the completed photoreceptor devices described in Examples I through V. The reverse peel strength was carried out by cutting a minimum of three 0.5 inch×6 inch (1.27 cm×2.36 cm) test specimens from each photoreceptor of the Examples. For each test specimen, the charge transport layer was partially stripped from the specimen with the aid of a razor blade and followed by hand peeling to about 3.5 inches from one end to expose the underlying photoreceptor coating layer inside the specimen. This stripped test specimen was then secured and held down onto a 1 inch×6 inches×0.125 inch aluminum backing plate, with the charge transport layer facing the backing plate, by a double sided adhesive tape. The end of the resulting specimen/aluminum backing plate assembly having the stripped charge transport layer was inserted into the upper jaw of an Instron Tensile Tester. The free polyester substrate end corresponding to the partially peeled charge transport layer was then inserted to the lower jaw of the Instron Tensile Tester. The Instron Tensile Tester was subsequently activated, to give a one inch per minute jaw separation crosshead speed, a two inches per minute recorded chart speed, and a load range calibrated for 2.0 gms full chart scale, to 180° peal the specimen to at least two inches. The peel strength of each test specimen, was therefore, calculated by dividing the load required to peel the polyester substrate 180° off from the specimen by the width of the test specimen (1.27 cm) and expressed the peel strength in gms per cm.

The results of the peel test, a summary of the charge blocking layer cracking examinations, and the corresponding solution viscosity are summarized in Table 1 below:

TABLE I

| Blocking Layer | HPC Content (% wt.) | Solution Viscosity (CP) | Layer Thickness (Micrometer) | Layer Cracking | 180° Peel Strength (gms/cm) |
|---|---|---|---|---|---|
| Example I (Control) | 0.0 | 5 | 0.7 | Extensive | 4.2 |
| Example II | 1.7 | 10 | 1.4 | None | 6.5 |
| Example III | 3.4 | 21 | 2.8 | None | 7.4 |
| Example IV | 5.3 | 40 | 3.0 | None | 7.4 |
| Example V | 9.1 | 201 | 3.0 | None | 7.2 |

The test results shown in the above table indicate that the reaction product of the organoaminosilane, hydroxyalkylcellulose, organozirconium compound, and the metal oxide on the underlying conductive surface enhances adhesion of the hole blocking layer to adjacent layers as well as eliminating cracking of the hole blocking layer.

EXAMPLE VII

The photoreceptor devices prepared according to Examples I through V were cut into 3 inch×4 inch samples and evaluated for their photoelectrical integrity using a xerographic testing scanner comprising a cylindrical aluminum drum having a diameter of 24.26 cm (9.55 inches). The test samples were taped onto the drum. When rotated, the drum carrying the samples produced a constant surface speed of 76.3 cm (30 inches) per second. A direct current pin corotron, exposure light, erase light, and five electrometer probes were mounted around the periphery of the mounted imaging samples. The sample charging time was 33 milliseconds. Both expose and erase lights had broad band white light (400–700 nm) outputs, each comprising a 300 watt output Xenon arc lamp. The relative locations of the probes and lights are indicated in Table II below:

TABLE II

| Element | Angle (Degrees) | Position | Distance From Photoreceptor |
|---|---|---|---|
| Charge | 0 | 0 | 18 mm (Pins)<br>12 mm (Shield) |
| Probe 1 | 22.50 | 47.9 mm | 3.17 mm |
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The test samples were first rested in the dark for at least 60 minutes to ensure achievement of equilibrium with the testing conditions at 5 percent relative humidity and 21° C. Each sample was then negatively charged in the dark to a development potential of about 900 volts. The charge acceptance of each sample and its residual potential after discharge by front erase exposure to 400 ergs/cm$^2$ were recorded. The test procedure was repeated to determine the photo induced discharge characteristic (PIDC) of each sample by different light energies of up to 20 ergs/cm$^2$. The 50,000 cycles of electrical testing results obtained for the test samples of the photoreceptor devices of Examples II through V showed that they all had essentially the same current-potential characteristics, photoinduced discharge (PIDC) properties, dark decay potentials, background and residual voltages, and stability as those of the control device of Example I. The results obtained demonstrate that the incorporation of hydroxypropylcellulose into the network structure of the final hole blocking layer to resolve the cracking problem does not deleteriously affect the many critical electrical characteristics of the fabricated photoreceptor device.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a substrate having an electrically conductive metal oxide surface, a hole blocking layer and at least one electrophotographic imaging layer, said hole blocking layer comprising a reaction product of (a) a material selected from the group consisting of a hydrolyzed organozirconium compound, a hydrolyzed organotitanium compound and mixtures thereof, (b) a hydroxyalkylcellulose, (c) a hydrolyzed organoaminosilane, and (d) said metal oxide surface.

2. An electrophotographic imaging member according to claim 1 wherein said electrophotographic imaging layer comprises a charge generating layer and a charge transport layer.

3. An electrophotographic imaging member according to claim 1 wherein said electrophotographic imaging layer is free of cracks under 100× magnification.

4. An electrophotographic imaging member according to claim 1 wherein said hydroxyalkylcellulose is represented by the following formula:

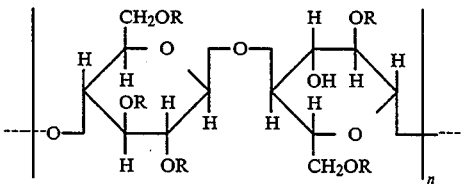

wherein R is independently selected from the group consisting of hydrogen and a substituted or unsubstituted group selected from the group consisting of an alkyl group containing 1 to 20 carbon atoms, a hydroxyalkyl group containing 1 to 20 carbon atoms, an hydroxyether group containing 1 to 20 carbon atoms and an aminoalkyl group containing 1 to 20 carbon atoms, and n is the number of cellulose repeating units from 1 to 3,000.

5. An electrophotographic imaging member according to claim 1 wherein said silane is a hydrolyzable organo silane represented by the following formula:

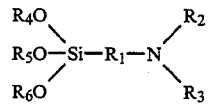

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and $R_4$, $R_5$, and $R_6$ are independently selected from a lower alkyl group containing 1 to 4 carbon atoms.

6. An electrophotographic imaging member according to claim 1 wherein said organozirconium compound and organotitanium compound are represented by the following formula:

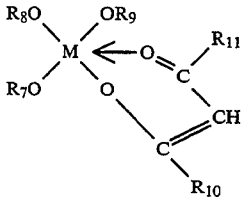

wherein

M is selected from the group consisting of zirconium and titanium and $R_{10}$ and $R_{11}$ are independently selected from lower alkyl groups containing one to 6 carbon atoms.

7. An electrophotographic imaging member according to claim 1 wherein said hole blocking layer is formed from a coating solution comprising between about 5 percent and about 9 percent by weight of the hydroxyalkylcellulose component based on the total solutes content of said coating solution.

8. An electrophotographic imaging member according to claim 7 wherein said hydroxyalkylcellulose component is hydroxypropylcellulose.

9. An electrophotographic imaging member according to claim 1 wherein said hole blocking layer is formed from a coating solution comprising between about 1.5 percent and about 3.5 percent by weight of said hydroxyalkylcellulose, between about 9.8 percent and about 96 percent by weight of said organoaminosilane, between about 88.7 percent and about 86.9 percent by weight of said organozirconium or said organotitanium compound, based on the total weight of solutes in said coating solution.

10. An electrophotographic imaging member according to claim 9 wherein said blocking layer is formed from a coating solution comprising between about 0.650 percent and about 0.647 percent by weight water, between about 56.4 percent and about 56.3 percent by weight isopropyl alcohol, between about 28.3 percent and about 28.2 percent by weight n-butanol, based on the total weight of said hole blocking layer coating solution.

11. An electrophotographic imaging member according to claim 1 wherein said organozirconium compound is monoacetyl acetonate zirconium trialkoxide.

12. An electrophotographic imaging member according to claim 11 wherein said monoacetyl acetonate zirconiumtrialkoxide is monoacetyl acetonate zirconium tributoxide.

* * * * *